US006709324B1

(12) United States Patent
Beadell

(10) Patent No.: US 6,709,324 B1
(45) Date of Patent: Mar. 23, 2004

(54) SIZE ADJUSTABLE COIN ESCALATOR FOR USE IN GAMING APPARATUS

(75) Inventor: John Leagh Beadell, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/560,709

(22) Filed: Apr. 27, 2000

(51) Int. Cl.[7] ..... G07D 1/00

(52) U.S. Cl. ..... 453/29; 453/57; 453/63; 194/344; 193/DIG. 1; 193/2 C; 193/25 FT; 198/723

(58) Field of Search ..... 194/344; 453/57; 221/267; 195/25 FT, 2 R, 2 C, DIG. 1; 198/480.1, 722, 723

(56) References Cited

U.S. PATENT DOCUMENTS

| | | | | | |
|---|---|---|---|---|---|
| 1,382,445 | A | * | 6/1921 | Smith | 53/230 |
| 2,860,573 | A | * | 11/1958 | Fox | 101/57 |
| 4,173,232 | A | * | 11/1979 | Asami et al. | 453/57 |
| 4,257,436 | A | | 3/1981 | Smith | 133/5 R |
| 4,518,001 | A | | 5/1985 | Branham | 133/5 R |
| 4,592,377 | A | | 6/1986 | Paulsen et al. | 133/5 R |
| 5,046,989 | A | | 9/1991 | Dass | 453/17 |
| 5,462,480 | A | * | 10/1995 | Suzukawa | 453/49 |
| 5,662,520 | A | * | 9/1997 | Evdokimo | 453/3 |
| 5,876,275 | A | | 3/1999 | Rasmussen | |
| 5,992,848 | A | | 11/1999 | Krutsch et al. | 273/127 R |
| 5,993,316 | A | | 11/1999 | Coyle et al. | 463/25 |
| 6,003,652 | A | * | 12/1999 | Murata et al. | 194/206 |

FOREIGN PATENT DOCUMENTS

| | | | | |
|---|---|---|---|---|
| JP | 10003577 A | * | 1/1998 | G07F/11/34 |
| KR | 2001003373 A | * | 6/1999 | G07F/9/00 |

* cited by examiner

*Primary Examiner*—Donald P. Walsh
*Assistant Examiner*—Jeffery Shapiro
(74) *Attorney, Agent, or Firm*—George H. Gerstman; Seyfarth Shaw LLP

(57) ABSTRACT

An adjustable escalator device is provided in a gaming terminal for receiving singulated coins from a gaming terminal output hopper and outputting coins at a higher level. The escalator can be adjusted to define a coin path of adjustable width and/or adjustable thickness and accommodate a range of coin or token sizes. In one aspect, a leaf spring or other flexible member can be moved to define a curved coin path portion with adjustable width and a preferably contiguous rail can be laterally transposed to adjust a width of a second portion of the coin path. Coin path thickness can be adjusted using different rail thicknesses, using shims and/or using screw adjustments.

24 Claims, 5 Drawing Sheets

SIZE ADJUSTABLE COIN ESCALATOR FOR USE IN GAMING APPARATUS

The present invention relates to an escalator for lifting coins in connection with outputting coins or tokens from a slot machine or other gaming terminal and in particular to an escalator method and apparatus providing adjustability, e.g., to accommodate numerous different coin diameters and/or thicknesses.

BACKGROUND INFORMATION

Many styles of slot machines, card game machines, keno machines and similar gaming machines or terminals are configured to output coins or tokens (including coins or tokens minted by governments and coins or tokens minted by casinos or similar gaming operators), e.g., to allow a "cash-out" operation and/or to provide prizes for players following a winning game outcome. Generally, a coin hopper or similar device singulates coins and provides coins, one at a time at a coin knife output region or other hopper output region. One example of a coin output hopper is described in U.S. patent application Ser. No. 5,167,571, incorporated herein by reference. Some gaming terminals are configured with the level of the hopper output region substantially below (such as, e.g., three to twelve inches or more below) the level which is desired or convenient for outputting the coins so as to be retrieved by the players. Accordingly, in some gaming terminal configurations, a device is provided which moves and/or guides coins along a path having a vertical component, from the output level of the coin hopper to the final, higher, coin output level. Such devices are sometimes referred to as escalators. One example of an escalator is described in U.S. Pat. No. 4,592,377, incorporated herein by reference.

Typically, a given coin escalator is configured to accommodate a single size (i.e., diameter and thickness) or denomination of coin or token. While there may be some tolerance in such prior escalators (e.g., to account for coin wear), previous approaches have generally made it necessary for those who fabricate, sell, maintain and/or use gaming terminals to keep, in stock, numerous different configurations of escalators, for use with different sizes or denominations of coins or tokens. Thus, previous approaches have been associated with an undesirably high stocking or warehousing cost for maintaining an inventory of numerous different sizes of escalators, including costs of warehouse or other storage space and associated costs such as security, insurance and the like. Furthermore, previous approaches have been associated with undesirable high costs of training various personnel to properly select, install, use or repair a number of different escalator configurations, including manufacturing personnel, maintenance personnel, sales personnel and others. Furthermore, there is significant design and/or tooling cost associated with creating a new escalator whenever a new size of coin or token is introduced.

Accordingly, it would be advantageous to provide an escalator apparatus, method and/or system which permits or facilitates adjustment, e.g., for accommodating a range of coin diameters, a range of coin thicknesses or, preferably, both.

SUMMARY OF THE INVENTION

The present invention includes a recognition of the existence, nature and/or source of problems in previous approaches, including as described herein. According to one embodiment, at least a portion of the coin path defined by the escalator is created by a substantially flexible and/or resilient member, e.g., a formed leaf spring, for contacting or guiding the perimeter or edge of coins or tokens for at least a portion of the coin or token path. In one embodiment, an entry or leading edge of the resilient member is coupled to a plate, with the plate being moveable, preferably along a constrained path, so as to adjust the position or shape of the resilient member for accommodating different coin diameters. Preferably, the trailing edge of the resilient member is moveable such as being directly or indirectly coupled to a second plate with the second plate being moveable to define and/or accommodate a range of coin diameters, e.g., at the region where the coin path merges into a linear path portion. In one embodiment, the second plate forms or defines a substantially linear wall for contacting or guiding the perimeter or edge of a coin or token. In one embodiment, the spacing of the second plate and/or of a cover plate, with respect to a back plate, can be modified or adjusted to accommodate a range of coin thicknesses, while substantially avoiding coin shingling or other jamming.

DETAILED DESCRIPTION OF THE PREFERRED EMBODIMENT

Figure 1:
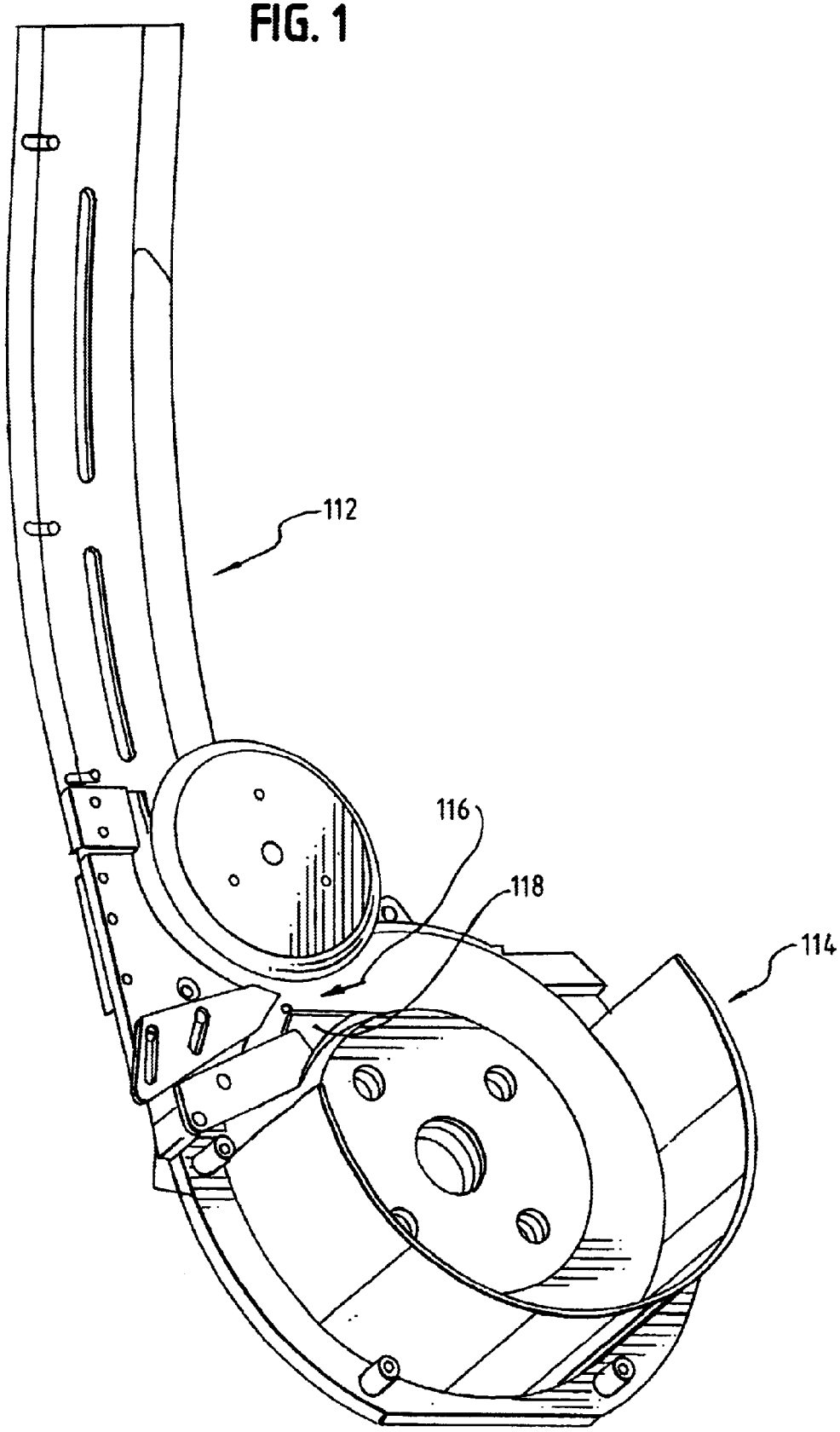
FIG. 1 is a perspective view of a output hopper and escalator according to an embodiment of the present invention.
Figure 2:
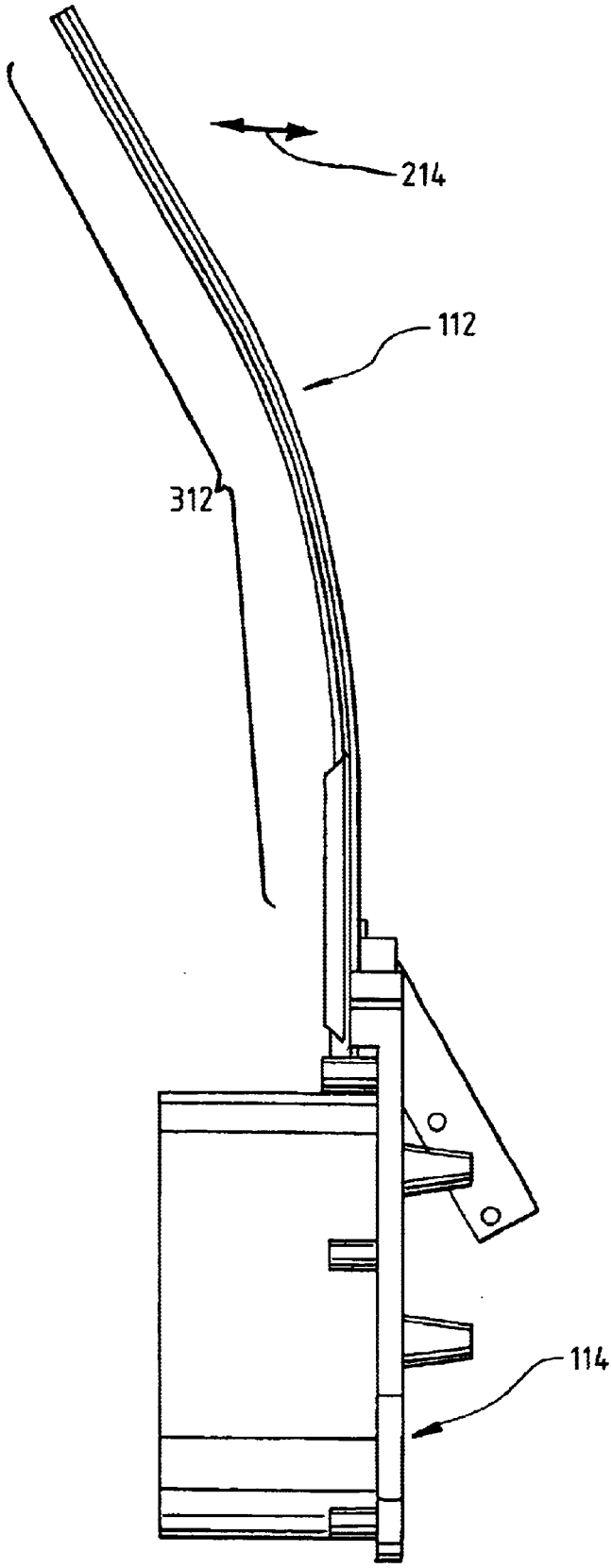
FIG. 2 is a side view of the hopper and escalator of FIG. 1.
Figure 3:
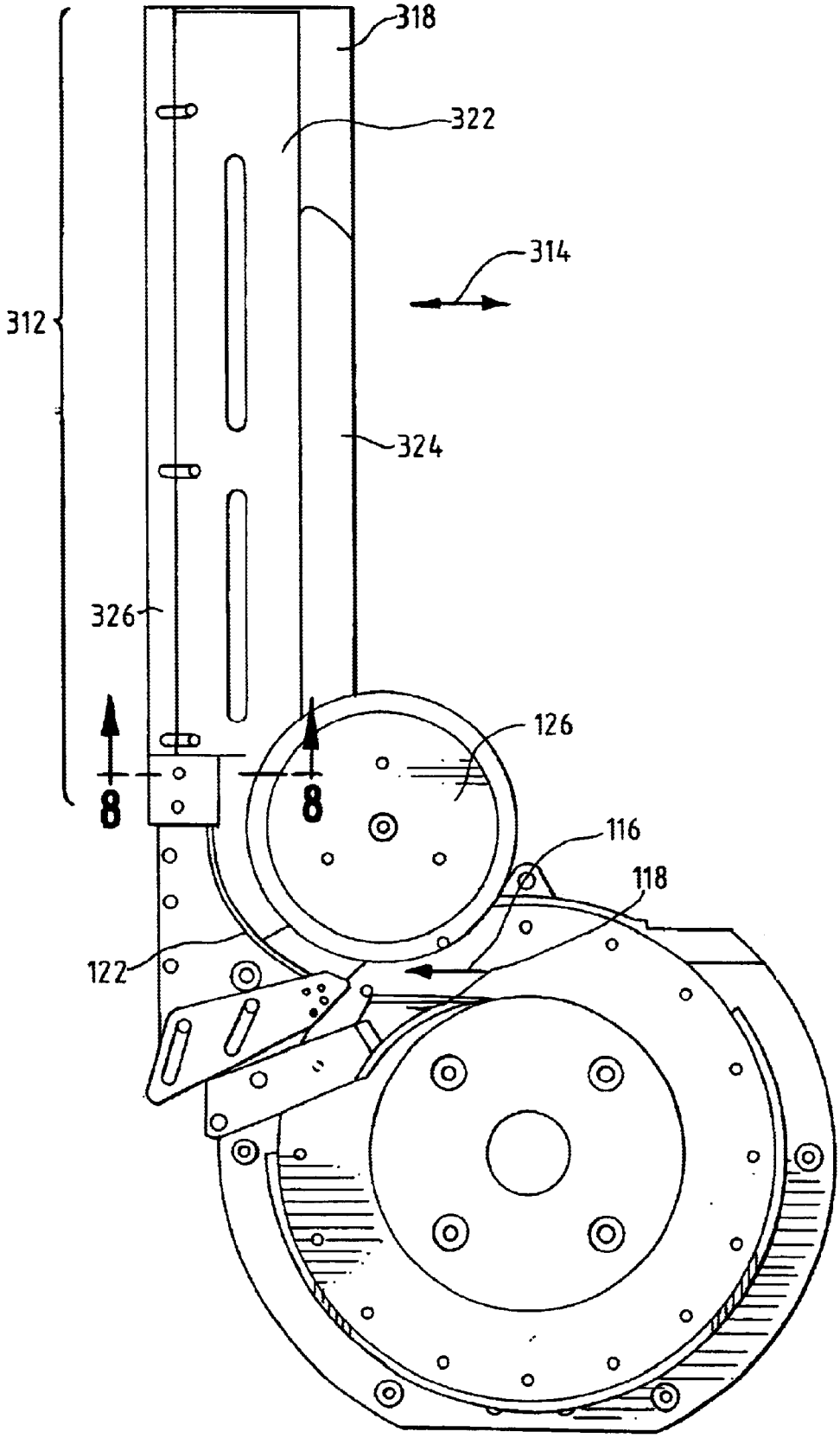
FIG. 3 is a front elevational view of the hopper and escalator of FIG. 1.

Features of the present invention can be used in connection with any of a number of different coin hoppers or other coin output devices. In the configuration depicted in FIG. 1, an escalator 112 is coupled to a coin output hopper 114 which outputs coins in a substantially horizontal direction 116 as initially guided by a hopper knife 118. In normal use, the coin hopper 114 is slanted or inclined and the escalator 112 is curved, as shown in FIG. 2. As seen in FIG. 3, after the coin leaves the hopper along the horizontal path 116, it enters the escalator and initially travels along a curved path defined between edge-contacting spring guide 122 and an edge 124 defined by a hub of a coin catching wheel 126. After traversing the curved portion of the coin path, the coin enters a portion of the coin path which is substantially straight 312 (with respect to a projection onto a vertical frontal plane, as depicted in FIG. 3). Although the portion 312 of the coin path is straight in the sense that the coins have substantially no movement in a lateral direction 314, the coin path is, in the depicted embodiment, substantially curved in a front-to-rear direction 214 as depicted in FIG. 2. It is in this sense that the upper portion 312 of the coin path is described herein as being straight while the initial portion of the coin path (adjacent the spring 122) is described herein as curved.

At least a portion of the upper coin path 312 provides a space 812 (FIG. 8) defined by a back plate 318 and a cover plate 322, each of which is adjacent or in contact with the opposed coin faces, and a fixed rail 324 and a moveable rail 326 which contact coin edges.

Figure 4A:
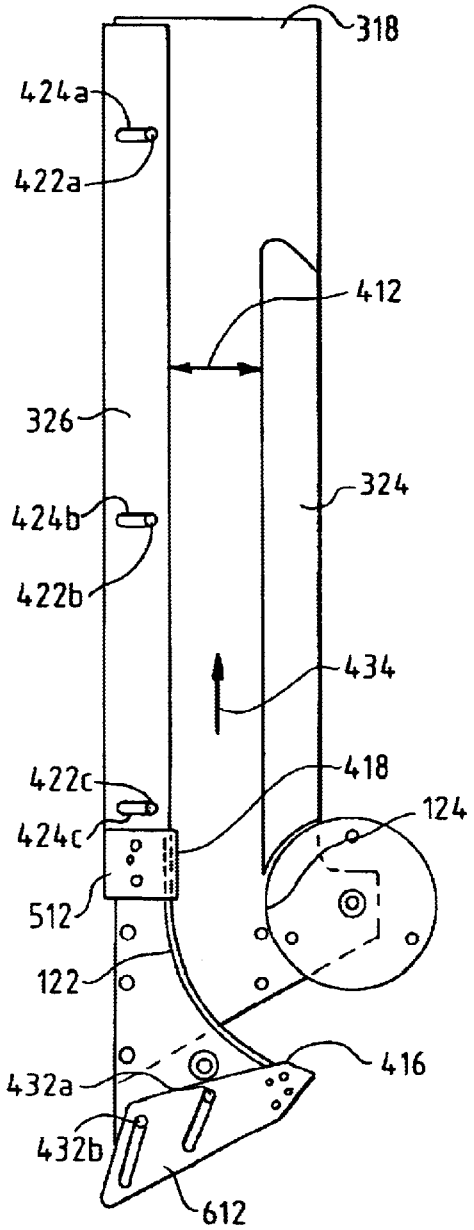
FIGS. 4A and 4B are front elevational views of the escalator of FIG. 1 with the top cover removed, adjusted for large and small diameter coins respectively.
Figure 4B:
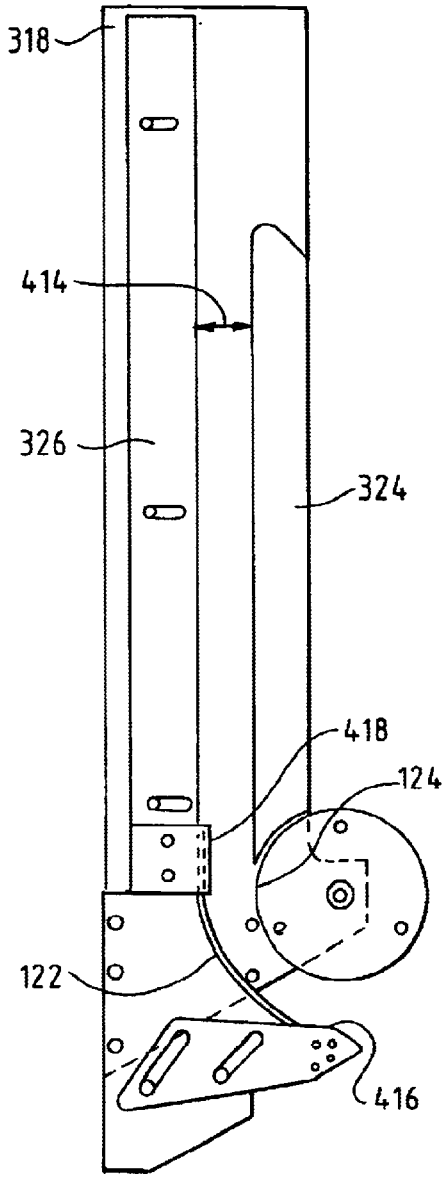
Figure 5:
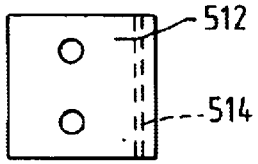
FIG. 5 is a front elevational view of a lock-down block according to an embodiment of the present invention.
Figure 6:
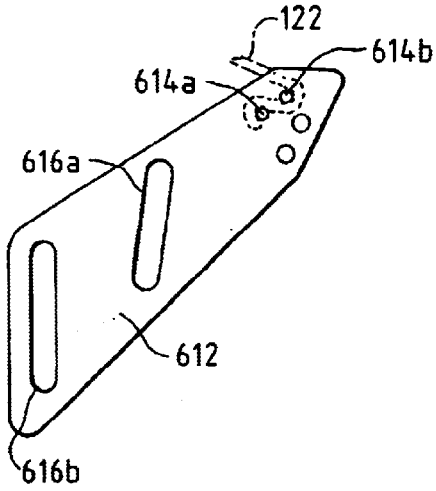
FIG. 6 is a front elevational view of an adjustment plate according to an embodiment of the present invention.

In the depicted embodiment, the escalator can be adjusted for accommodating different sizes of coins, at least by moving the moveable rail 326 and the spring guide 122. For example, the moveable rail 326 and radius spring 122 can be moved from the configuration depicted in FIG. 4A, defining a first coin path width 412 to the configuration depicted in FIG. 4B defining a second coin path width 414.

Figure 8:
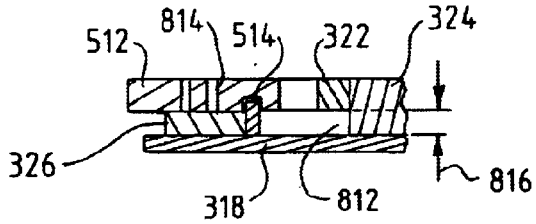
FIG. 8 is a cross-sectional view taken along the line 8—8 of FIG. 3.

By including moveability and/or adjustability of a flexible and/or resilient member such as the spring 122, it becomes feasible to provide for adjustability, even though a portion of the path is curved or nonlinear. In the depicted embodiment, the configuration or position of the guide spring or "radius spring" 122 is changed by changing the position and/or tangent angle of the effective leading edge or entry region 416 of the radius spring 122 and the trailing or exit region 418 of the radius spring 122. In the depicted embodiment, the trailing edge 418 of the radius spring is moved substantially with movement of the moveable rail 326. Although various schemes can be used for accommodating movement of the moveable rail 326, in the depicted embodiment, pins 422*a,b,c* projecting from the back plate 318 are received in slots 424*a,b,c* of the moveable rail 326 to guide the moveable rail 326 for movement in the lateral direction 314 while maintaining the moveable rail 326 substantially parallel to the fixed rail 324. In the depicted embodiment, the trailing edge 418 of the radius spring 122 moves with the rail 326 because the radius spring trailing edge 418 is coupled to the moveable rail 326 by a lock-down block 512. As best seen in FIG. 8, the lock-down block 512 is coupled, e.g. by bolts 814 to the moveable rail 326. The lock-down block 512 includes a groove 514 sized and shaped to receive the trailing end 418 of the radius spring 122. Accordingly, when the moveable rail 326 is moved from the position of FIG. 4A to the position of FIG. 4B, the trailing edge 418 of the radius spring 122 moves along with the moveable rail 326. Preferably, during such movement, the bolts 814 are somewhat loosened to accommodate any (e.g. longitudinal) sliding or other movement of the trailing edge 418 of the radius spring 122 with respect to the lock-down block 512 which may accompany the adjustment.

Figure 7:
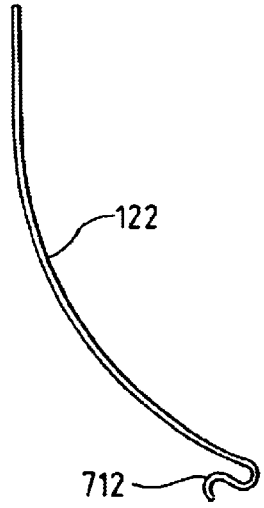
FIG. 7 is a front elevational view of a radius spring according to an embodiment of the present invention.

The leading edge 416 of the radius spring 122 is coupled to a guide plate 612. In the depicted embodiment, a serpentine or S-shaped end region 712 of the radius spring 122 (FIG. 7) is configured to engage pins 614*a,b* projecting backward from the undersurface of the adjustment plate 612. The manner in which the adjustment plate 612 can move is constrained by the engagement of first and second pins 432*a,b* in (preferably curved) slots 616*a,b* of the adjustment plate 612. The size and shape of the slots 616*a,b* are configured so that, regardless of the amount of adjustment of the adjustment plate 612, e.g., between the configuration depicted in 4A and the configuration depicted in 4B, the leading edge 416 of the radius spring 122 will be positioned in a manner so as to define a curved coin path portion which will accommodate (when accompanied by appropriate adjustment of the trailing edge 418) a coin substantially without jamming and while defining (in conjunction with the hub edge 124) a coin path appropriate for guiding the coin from a horizontal exit direction 116 to a vertical direction 434.

A number of materials, or combinations of materials, can be used to form the plates, rails, guides, radius spring, and/or other components of the escalator. Preferably metal, such as stainless steel or other steel, aluminum or the like, is used, although some or all components may be formed from or coated with plastics, ceramics, fiberglass, resins, epoxy and the like.

In the depicted embodiment, the cover plate 322 is mounted in a manner which is substantially constant in a lateral direction 314. However, preferably the apparatus can be adjusted so as to change the thickness 816 (FIG. 8) of the space 812 defining the coin path. For example, thickness 816 can be increased by providing a relatively taller or thicker moveable plate 326 (since, in the depicted embodiment, the cover plate 322 is positioned substantially on top of and in contact with a portion of the moveable plate 326). Alternatively, a thin shim or supplemental plate can be positioned, e.g. between the moveable plate 326 and the back plate 318 or the cover plate 322. As will be understood by those of skill in the art, it is also possible to provide for screw adjustment or a similar adjustment of the height or spacing of the moveable plate 326 with respect to the back plate 318.

Figure 9A:
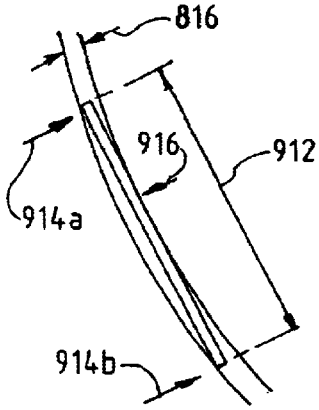
FIGS. 9A and 9B are partial cross-sectional views through a portion of an escalator adjusted to different thicknesses illustrating potential jamming problems.
Figure 9B:
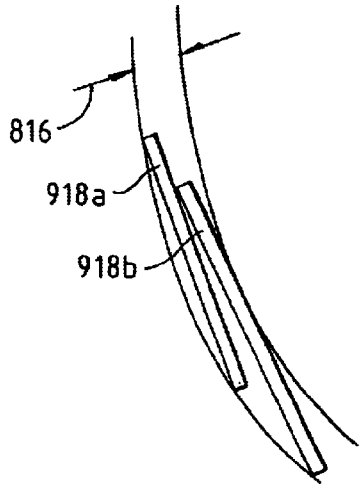

Without wishing to be bound by any theory, it is believed that providing for adjustment of the thickness 816 of the coin path is particularly advantageous when a range of coin sizes which includes both relatively large diameter and thin coins as well as relatively smaller diameter and thick coins is to be accommodated by the device having a profile which is curved in the fore-aft direction 214 (FIG. 2). For example, as depicted in FIG. 9A, when a curved coin path is used in conjunction with a coin which is relatively large in diameter 912 but relatively thin, there is a potential for a relatively thin coin path 816 to cause jamming with respect to perimeter portions of a coin 914*a,b* adjacent one wall of the path and a mid-portion 916 adjacent another wall. However, if a coin path is provided which has a thickness 816 which is relatively wide as depicted in FIG. 9B, there is a potential for coin shingling with respect to adjacent coins 918*a* 918*b*. Thus, depending on the coin size and shape, it can be infeasible to accommodate a range of coin thicknesses and diameters unless, as described herein, provision is made for adjusting the thickness 816 of the coin path.

In light of the above description, a number of advantages of the present invention can be seen. The present invention can make it feasible to use a single coin output escalator for a gaming machine to accommodate a range of coin diameters and/or thicknesses, thus reducing or avoiding costs associated with the need for multiple escalators. For example, in one embodiment, it is possible to accommodate substantially all current coins or tokens within a size range between 0.8 inch diameter and about 2 inch diameter with only 3 different escalators, such as, for example, a first escalator adjustable to accommodate coins between about 0.8 inches and about 1.2 inches diameter, a second escalator for accommodating coins between about 1.2 inches and about 1.6 inches diameter and a third escalator for accommodating coins between about 1.6 inches diameter and about 2 inches diameter. It is also possible to provide systems which accommodate a desired range of coins or tokens using fewer than 3 or more than 3 different escalators and/or using escalators which have or accommodate size ranges different from those noted in the above example.

A number of variations and modifications of the invention can be used. It is possible to use some features of the invention without using others. For example, it is possible to provide for coin path width adjustment without providing for coin path thickness adjustment and vice versa. It is possible to provide an escalator with a portion of the path defined by a flexible or resilient member without using the flexible or resilient member for adjustment purposes. Although embodiments of the present invention have shown pin-and-slot engagements for guiding plate movement to provide adjustment, other types of guidance can be used including track and groove guidance, edge rail guidance, screw thread guidance and the like. Embodiments of the present invention can be implemented by using a device other than a lock-down block for coupling the radius spring trailing edge to the moveable rail, including direct connection such as welding, brazing, adhesives and the like, bolt or screw connections, clamp connections and the like. Although the depicted embodiment shows only a single moveable rail, it is also possible to provide embodiments which include movement of two or more rails and/or movement of a coin catching wheel 126 or hub edge 124 (if provided).

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A coin escalator apparatus for use in a gaming device, receiving singulated coins from a coin output hopper exit location at a first level and outputting coins at a second, higher, level, comprising:

a flexible member for contacting a coin edge defining a first curved coin path portion;

a rail at a higher level than said flexible member, said rail having a first end contiguous with a trailing portion of said flexible member to define a second portion of said coin path which is substantially straight in at least one direction;

said flexible member being moveable and flexible, with respect to said hopper exit location, to adjust a width and curvature of said first coin path portion; and said rail being moveable, with respect to said hopper exit location, to adjust the coin path width of said second coin path portion.

2. An apparatus, as claimed in claim 1, further comprising an adjustment plate coupled to a leading edge of said flexible member wherein movement of said adjustment plate results in movement of said leading edge; and at least a first adjustment plate guide which controls movement of said adjustment plate.

3. An apparatus, as claimed in claim 2, wherein said adjustment plate guide comprises a pin and slot engagement system.

4. An apparatus as claimed in claim 1, wherein movement of said rail results in movement of said trailing portion of said flexible member.

5. An apparatus, as claimed in claim 4, further comprising a coupler connecting said trailing portion of said flexible member to said rail.

6. Apparatus, as claimed in claim 1, further comprising a rail guide which controls movement of said rail.

7. An apparatus, as claimed in claim 6, wherein said rail guide comprises a pin and slot engagement system.

8. An apparatus, as claimed in claim 1, wherein said flexible member comprises a formed leaf spring.

9. An apparatus, as claimed in claim 1, wherein said flexible member is formed from steel.

10. An apparatus, as claimed in claim 1, wherein said rail is formed from steel.

11. An apparatus, as claimed in claim 1, further comprising a shim adjacent a portion of at least said rail which affects an effective thickness of said coin path.

12. A method for adjusting a coin escalator used in a gaming device, said coin escalator receiving singulated coins from a coin output hopper exit location at a first level and outputting coins at a second, higher level, the method comprising position a flexible member to contact an edge of a coin as said coin, said flexible member defining a first curved coin path portion;

movably mounting a rail to define a second portion of said coin path which is substantially straight in at least one direction and at a higher level than said flexible member said rail having a first end contiguous with a trailing portion of said flexible member;

moving said flexible member, with respect to said coin output hopper, to adjust a width of said first coin path portion; and moving said rail with respect to said coin output hopper, to adjust the coin path width of said second coin path portion.

13. A method as claimed in claim 12 further comprising coupling a leading edge of said flexible member to an adjustment plate wherein movement of said adjustment plate results in movement of said leading edge; and guiding said adjustment plate to control movement of said adjustment plate.

14. A method as claimed in claim 12 wherein movement of said rail results in movement of said trailing portion of said flexible member.

15. A method as claimed in claim 14 further comprising coupling said trailing portion of said flexible member to said rail.

16. A method as claimed in claim 12 further comprising guiding movement of said rail to control movement of said rail.

17. A method as claimed in claim 12 further comprising adjusting at least a portion of said rail to change an effective thickness of said coin path.

18. A coin escalator apparatus for use in a gaming device receiving singulated coins from a coin output hopper exit location at a first level and outputting coins at a second, higher, level comprising:

first means for defining a first curved path portion;

second means for defining a second portion of said coin path at a higher level than said first means, said second means being substantially inflexible in at least one direction, said second means having a first end contiguous with a trailing portion of said first means;

means for mounting said first means to provide movement of said first means with respect to said hopper exit location for adjusting- a width of said first coin path portion; and means for mounting said second means with respect to said hopper exit location for adjusting coin path width of said second coin path portion.

19. Apparatus as claimed in claim 18 further comprising adjustment means coupled to a leading edge of said first means wherein movement of said adjustment means results in movement of said leading edge; and first guide means which controls movement of said adjustment means.

20. Apparatus as claimed in claim 18 further comprising means for coupling said trailing portion of said first means to said second means wherein movement of said second means results in movement of said trailing portion of said first means.

21. Apparatus as claimed in claim 18 further comprising second guide means for controlling movement of said second means.

22. Apparatus as claimed in claim 18 wherein said first means is substantially flexible in at least said first direction.

23. Apparatus as claimed in claim 18 further comprising means for adjusting an effective thickness of said coin path.

24. The method as claimed in claim 12 in which said step of moving said flexible member and the step of moving said rail are substantially simultaneous.

* * * * *